US012257468B2

(12) United States Patent
Chen

(10) Patent No.: US 12,257,468 B2
(45) Date of Patent: Mar. 25, 2025

(54) FAN BIKE PROVIDING MAGNETICALLY CONTROLLED RESISTANCE

(71) Applicant: Xiamen Klifesport Co., Ltd., Fujian (CN)

(72) Inventor: Xiaowu Chen, Fujian (CN)

( * ) Notice: Subject to any disclaimer, the term of this patent is extended or adjusted under 35 U.S.C. 154(b) by 139 days.

(21) Appl. No.: 18/223,012

(22) Filed: Jul. 17, 2023

(65) Prior Publication Data

US 2023/0356018 A1 Nov. 9, 2023

(51) Int. Cl.
*A63B 21/00* (2006.01)
*A63B 22/06* (2006.01)

(52) U.S. Cl.
CPC .... *A63B 21/00192* (2013.01); *A63B 22/0605* (2013.01); *A63B 2022/0611* (2013.01)

(58) Field of Classification Search
CPC ..... A63B 21/005; A63B 21/0051; A63B 21/0052; A63B 21/00192; A63B 22/0605; A63B 22/0664; A63B 2022/0611
See application file for complete search history.

(56) References Cited

U.S. PATENT DOCUMENTS

2021/0205650 A1* 7/2021 Wang ..... A63B 21/0052
2021/0220690 A1* 7/2021 Wang ..... A63B 23/1209
2022/0131454 A1* 4/2022 Lin ..... H02K 49/046
2023/0256293 A1* 8/2023 Lu ..... A63B 21/00069 482/57
2024/0342536 A1* 10/2024 Tzeng ..... A63B 21/0051

* cited by examiner

*Primary Examiner* — Zachary T Moore

(57) ABSTRACT

A fan bike providing magnetically controlled resistance, having a fan wheel and a micro adjustment assembly mounted on a bike frame; the fan wheel is rotationally mounted on the bike frame, and one side of which is given an iron ring and an aluminum ring. The micro adjustment assembly has a fixed seat inside the bike frame, a movable seat slidably mounted in the fixed seat, at least one magnet on the movable seat facing to the aluminum ring, an adjustment handle outside the bike frame, and a pulling wire connected between the movable seat and the adjustment handle. The magnetically controlled resistance provided by the fan bike is adjustable.

10 Claims, 4 Drawing Sheets

FAN BIKE PROVIDING MAGNETICALLY CONTROLLED RESISTANCE

BACKGROUND OF THE INVENTION

The present invention relates to the technical field of gym equipment, and more specifically relates to a fan bike providing magnetically controlled resistance.

In sports science, an exercise bike is specifically called an ergometer bike. There are two types of exercise bike, namely upright bike and recumbent bike. An exercise bike is provided with different power levels which can be adjusted so as to achieve body fitness. Therefore, it is a typical aerobic and cardio training equipment that simulates an outdoor sport.

A fan bike is also a kind of exercise bike. Resistance of a fan bike is mainly provided by a fan wheel. During training, the user has to keep pedaling and optionally pulling the handles alternately to rotate the fan wheel and overcome the resistance encountered by the fan wheel as the fan wheel rotates. By continually overcoming the resistance, training is achieved. However, when the fan keeps rotating in a stable speed, the resistance will not change, thereby providing only unvaried training effect that lacks adjustability and versatility.

BRIEF SUMMARY OF THE INVENTION

In view of the aforesaid disadvantages in the prior art, it is an object of the present invention to provide a fan bike providing magnetically controlled resistance, so that the fan bike is equipped with adjustable resistance in order to meet different training needs.

To achieve the above object, the present invention provides the following technical solutions:

A fan bike providing magnetically controlled resistance, comprising a fan wheel and a micro adjustment assembly, both installed on a bike frame; the fan wheel is rotatably mounted on the bike frame; one side of the fan wheel is fixedly connected sequentially with an iron ring and an aluminum ring; the iron ring and the aluminum ring are co-axial with the fan wheel; the micro adjustment assembly comprises a fixed seat, a movable seat, at least one neodymium magnet, an adjustment handle, and a pulling wire; the fixed seat is mounted inside the bike frame; the movable seat and the fixed seat are slidably connected; the neodymium magnet is mounted on the movable seat, and faces towards a side of the aluminum ring facing opposite to the iron ring; the adjustment handle is movably mounted outside the bike frame; two ends of the pulling wire are connected to the movable seat and the adjustment handle respectively.

A plurality of blades are provided circumferentially around the fan wheel; the blades are spaced apart from one another by a same angle.

The fan wheel is positioned on one side of the iron ring facing opposite to the aluminum ring; the aluminum ring is positioned on another side of the iron ring facing opposite to the fan wheel; said another side of the iron ring facing opposite to the fan wheel is also provided with an installation groove in which the aluminum ring is mounted.

The fan wheel is rotatably connected to the bike frame through a rotational shaft; a bearing is also provided between the rotational shaft and the fan wheel.

A side of the fixed seat facing towards the fan wheel is provided with a sliding rail; a side of the movable seat facing away from the fan wheel is provided with a sliding block; the sliding block is slidably mounted on the sliding rail.

Preferably, the sliding rail is oriented along a radial direction of the fan wheel.

An upper end of the fixed seat is provided with a notch that mounts the pulling wire.

A side of the movable seat facing towards the fan wheel is provided with an arc-shaped mounting plate; a plurality of neodymium magnets are fixedly connected to the mounting plate.

An outer side of the bike frame is provided with a pivotal seat; one end of the adjustment handle is pivotally mounted to the pivotal seat.

The micro adjustment assembly also comprises a spring connected between the bike frame and the movable seat; an upper end of the movable seat is fixedly connected with a lower end of the pulling wire; a lower end of the movable seat is fixedly connected with an upper end of the spring; a lower end of the spring is fixedly connected in an interior of the bike frame.

According to the above technical solutions, the present invention has the following technical effects:

1) The present invention provides the iron ring and the aluminum ring on one side of the fan wheel, and also provides a movable seat which is movable with respect to the fan wheel, and neodymium magnets are mounted on the movable seat. Accordingly, the fan bike is additionally equipped with adjustable non-contact type magnetically controlled resistance. Specifically, magnetically controlled resistance is achieved by non-contact action force between the neodymium magnets and the aluminum ring that achieves cutting of magnetic field lines to create reaction force that constitutes a resistant force against the rotation of the fan wheel. Such magnetically controlled resistance force is stable and adjustable.
2) User may freely choose among different levels of stable resistance provided by the present invention a suitable resistance for training by operating the adjustment handle. During training, the legs and hands can apply balanced forces and hence the user is saved from easy muscle injuries. Also, during training, stable wind resistance is provided by the fan bike and wind may be generated during training, therefore providing a better training experience and more prominent training effect.

DETAILED DESCRIPTION OF THE INVENTION

Figure 1:
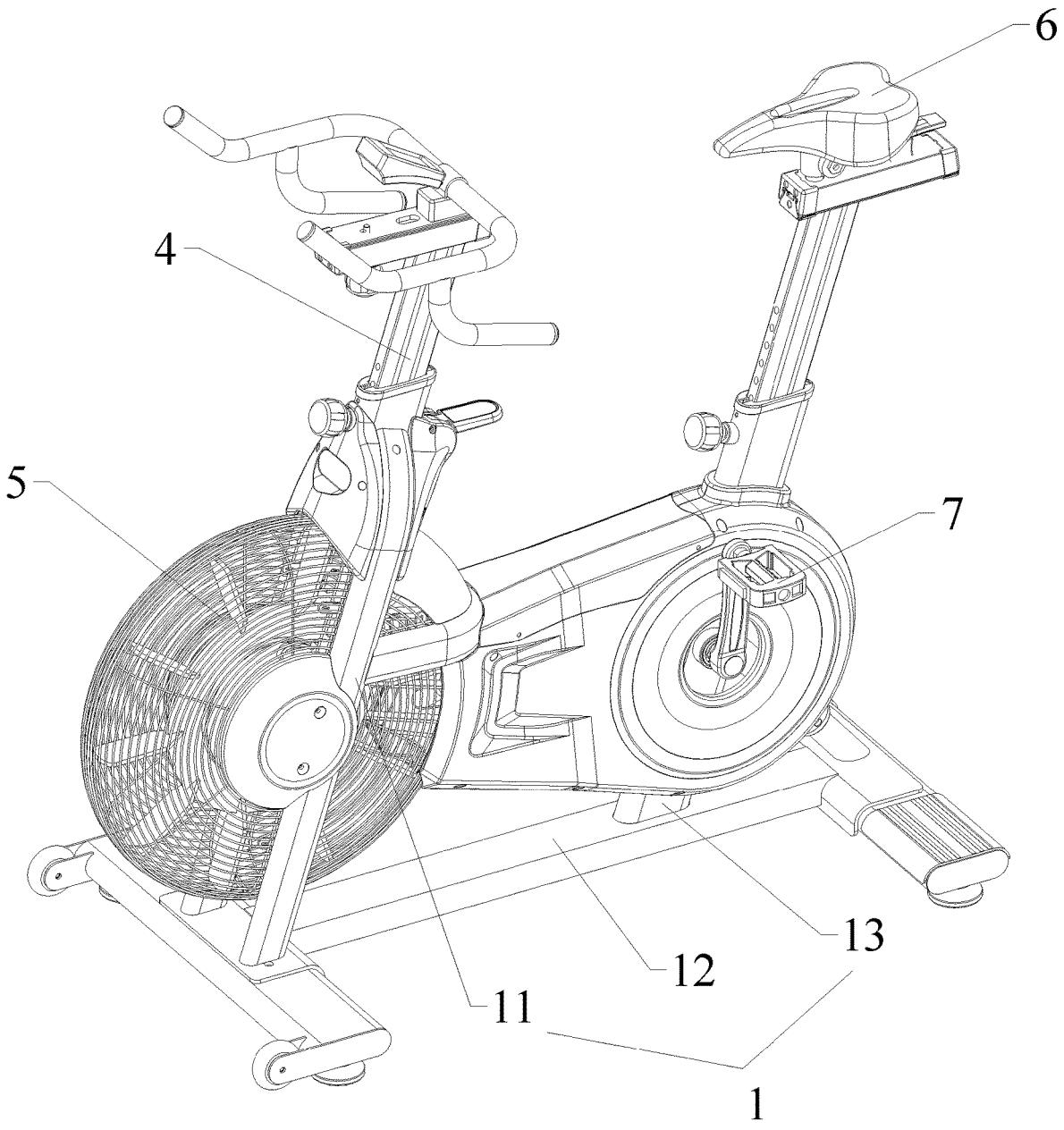
FIG. 1 is a perspective view according to an embodiment of the present invention.
Figure 2:
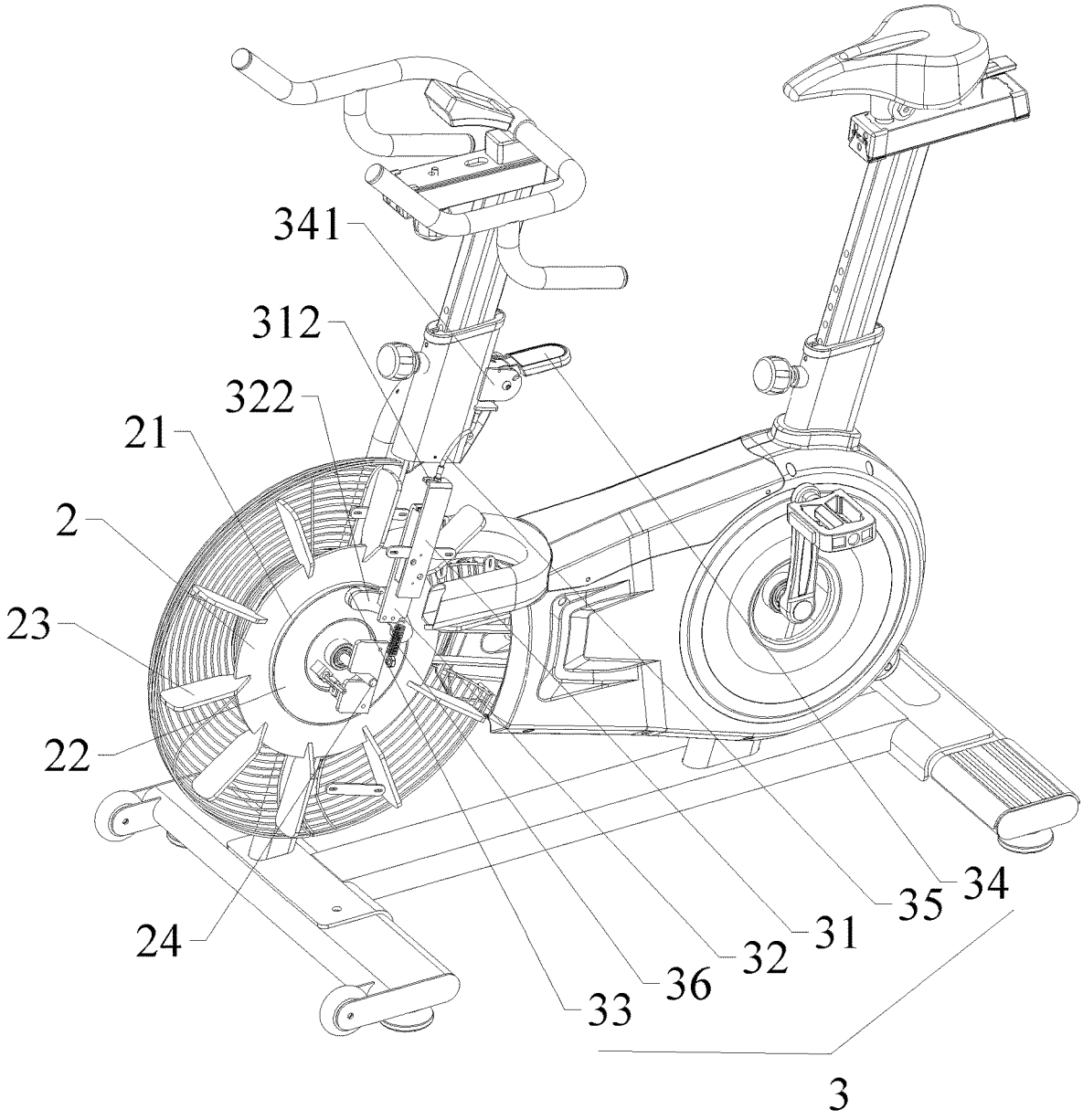
FIG. 2 is a perspective view that partially shows the structure according to an embodiment of the present invention.

To further understand the technical solutions of the present invention, the present invention is described in detail below with reference to an embodiment.

With reference to FIGS. 1-4, the present invention provides a fan bike providing magnetically controlled resistance, comprising a fan wheel 2 and a micro adjustment assembly 3, both installed on a bike frame 1.

The fan wheel 2 is rotatably mounted on the bike frame 1; one side of the fan wheel 2 is fixedly connected sequentially with an iron ring 21 and an aluminum ring 22; the iron ring 21 and the aluminum ring 22 are co-axial with the fan wheel 2.

The micro adjustment assembly 3 comprises a fixed seat 31, a movable seat 32, at least one neodymium magnet 33, an adjustment handle 34, and a pulling wire 35; the fixed seat 31 is mounted inside the bike frame 1; the movable seat 32 and the fixed seat 31 are slidably connected; the neodymium magnet 33 is mounted on the movable seat 32, and faces towards a side of the aluminum ring 22 facing opposite to the iron ring 21; the adjustment handle 34 is movably mounted outside the bike frame 1, and is located at a position that facilitate a user to access and operate during training; two ends of the pulling wire 35 are connected to the movable seat 32 and the adjustment handle 34 respectively.

A specific embodiment of the present invention is described below.

The bike frame 1 is a main frame of the fan bike. The bike frame 1 comprises components such as a front tube 11, a supporting frame 12 and a rear tube 13. A handle supporting bar 4 and a wire guard 5 of the fan bike are installed on the front tube 11; a front end of the supporting frame 12 is connected to the front tube 11, and a rear end of the supporting frame is connected to the rear tube 13; components like bike seat 6 and pedals 7 are installed on the rear tube 13; the pedals 7 are connected to the fan wheel 2 and transmit motions to the fan wheel 2 through a belt assembly. The fan wheel 2 and the micro adjustment assembly 3 are substantially installed on the front tube 11, but certain parts (for example, the adjustment handle 34) of the micro adjustment assembly 3 may be installed onto other positions according to practical requirements of the product.

A plurality of blades 23 are provided circumferentially around the fan wheel 2; the blades 23 are spaced apart from one another by a same angle. Each of the blades 23 is wider towards an end distal from the fan wheel 2 than an end proximal to the fan wheel 2. Each of the blades 23 is also structured as a flat plate extending out of the fan wheel 2 along a radial direction of the fan wheel 2.

The fan wheel 2 is positioned on one side of the iron ring 21 facing opposite to the aluminum ring 22; in other words, the aluminum ring 22 is positioned on another side of the iron ring 21 facing opposite to the fan wheel 2; said another side of the iron ring 21 facing opposite to the fan wheel 2 is also provided with an installation groove 211 in which the aluminum ring 22 is mounted.

The iron ring 21 and the aluminum ring 22 can be fixed connected to said one side of the fan wheel 2 by welding or by screw driving so as to reinforce the connection between the fan wheel 2, the iron ring 21 and the aluminum ring 22.

The fan wheel 2 is rotatably connected to the bike frame 1 through a rotational shaft 24, so that the fan wheel 2 may rotate with the rotational shaft 24 being a rotational axis. In this embodiment, a bearing 25 is also provided between the rotational shaft 24 and the fan wheel 2 so that the fan wheel 2 can rotate more smoothly.

A side of the fixed seat 31 facing towards the fan wheel is provided with a sliding rail 311; a side of the movable seat 32 facing away from the fan wheel is provided with a sliding block 321; the sliding block 321 is slidably mounted on the sliding rail 311 to achieve slidable connection between the fixed seat 31 and the movable seat 32.

Further, the sliding rail 311 is oriented along a radial direction of the fan wheel 2, so that the movable seat 32 together with the neodymium magnet 33 mounted on the movable seat 32 is slidable along a radial direction of the fan wheel 2 so that an overlapping area between the neodymium magnet 33 and the aluminum ring 22 viewed along an axial direction of the fan wheel can be adjusted by linear movement of the movable seat 32 along the radial direction of the fan wheel. Accordingly, user can be more easily and conveniently achieve resistance adjustment.

An upper end of the fixed seat 31 is provided with a notch 312 that mounts the pulling wire 35. Specifically, an end of a sleeve for the pulling wire 35 is fixed in the notch 312 to achieve mounting of the pulling wire 35 on the fixed seat 31.

Figure 3:
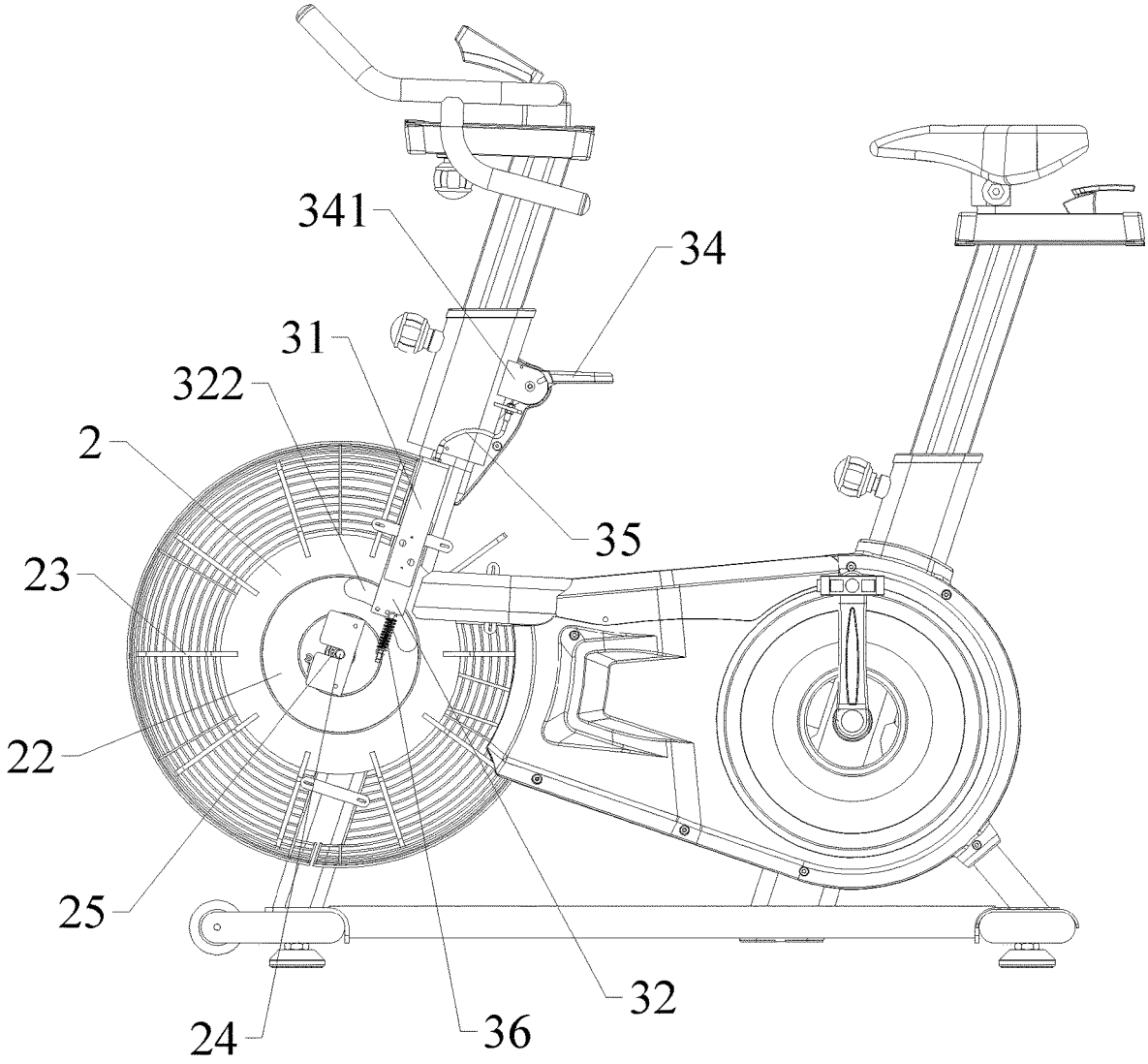
FIG. 3 is a side view that partially shows the structure according to an embodiment of the present invention.

Another side of the movable seat 32 facing towards the fan wheel is provided with an arc-shaped mounting plate 322; a plurality of neodymium magnets 33 are fixedly connected to the mounting plate 322; in an initial position, the entire mounting plate 322 overlaps a portion of the aluminum ring 22 when viewed along an axial direction of the fan wheel (as shown in FIG. 3) so that all and entire neodymium magnets 33 fixedly connected to the mounting plate 322 also overlaps a portion of the aluminum ring 22 when viewed along the axial direction of the fan wheel. In this entirely overlapping position, the resistance is the greatest. When the mounting seat 32 is driven by the pulling wire 35 to move upward gradually, the neodymium magnets 33 will gradually impose lesser resistance against the rotation of the fan wheel 2.

The adjustment handle 34 can be mounted to the bike frame 1 in various different ways, provided that that the adjustment handle 34 is able to drive the pulling wire 35 to pull the movable seat 32. For example, the adjustment handle 34 can be pivotally mounted with the bike frame 1, or can be mounted on the bike frame 1 such that it is extendable and retractable with respect to the bike frame 1. In this embodiment, an outer side of the bike frame 1 is provided with a pivotal seat 341; one end of the adjustment handle 34 is pivotally mounted to the pivotal seat 341. Therefore, when the adjustment handle 34 moves pivotally about the pivotal seat 341, the pulling wire 35 is driven to move and thereby pulling the movable seat 32.

The micro adjustment assembly 3 also comprises a spring 36 connected between the bike frame 1 and the movable seat 32; an upper end of the movable seat 32 is fixedly connected with a lower end of the pulling wire 35; a lower end of the movable seat 32 is fixedly connected with an upper end of the spring 36; a lower end of the spring 36 is fixedly connected in an interior of the bike frame 1. By means of the spring 36, resilience is provided so as to reset the movable seat 32 together with the neodymium magnets 33 fixedly connected thereon.

Further, the interior of the bike frame 1 is welded with the nut 37; the lower end of the spring 36 is hooked onto the nut 37. The nut 37 may be alternatively configured as any other ring-shaped component.

Figure 4:
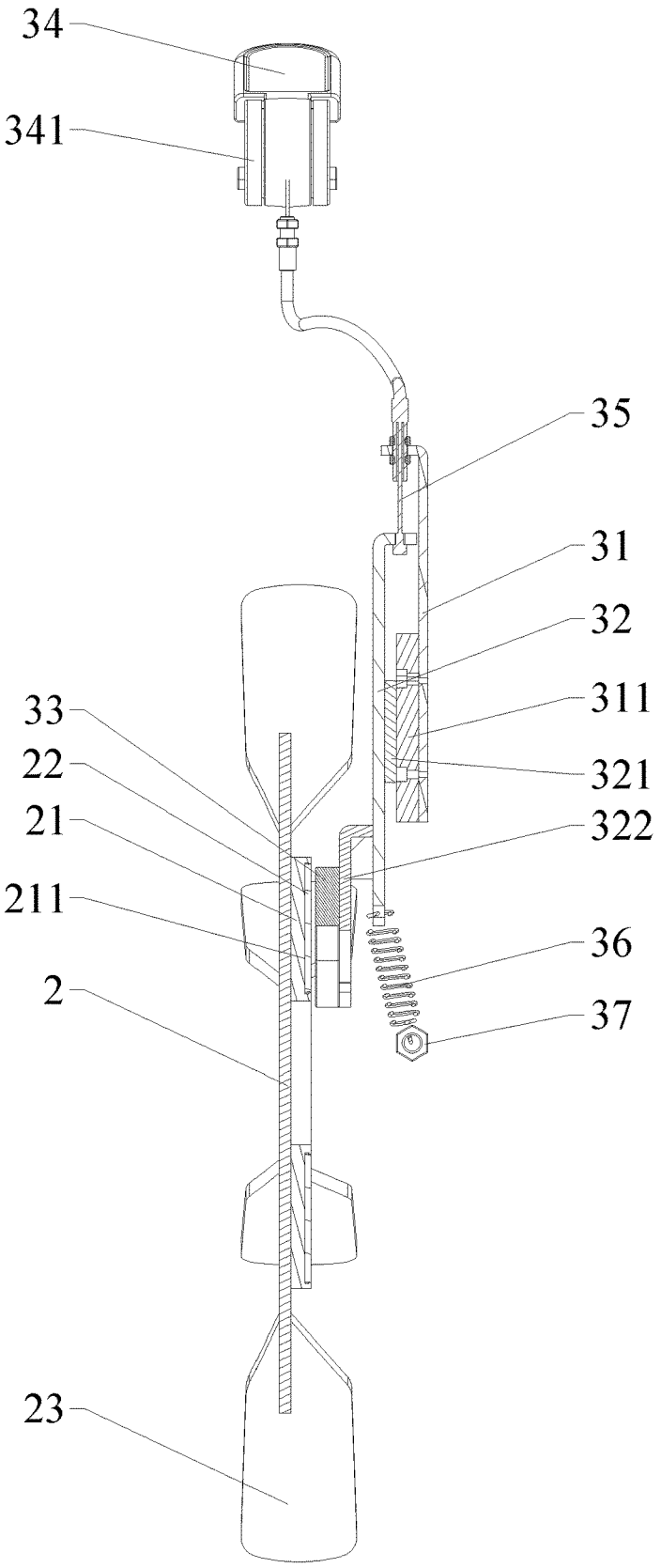
FIG. 4 is a schematic illustration that shows how the magnetically controlled resistance is provided according to an embodiment of the present invention.

With reference to FIG. 3 and FIG. 4, the operating principle of the present invention is described below:

1) Pedaling the fan bike through the pedals 7 so as to rotate the fan wheel 2 through the belt assembly;
2) Action force will be created between the fan wheel 2 and the neodymium magnets 33; specifically, the iron ring 21 and the aluminum ring 22 as a whole will cut the magnetic field lines of the neodymium magnets 33 to create resistance, and such resistance together with the ordinary wind resistance encountered by the fan wheel 2 during rotation of the fan wheel 2 constitute the total resistance that user has to overcome during training;

3) The resistance generated between the neodymium magnets 33 and the fan wheel 2 is proportional to the overlapping area between the neodymium magnet 33 and the assembly of the iron ring 21 and the aluminum ring 22 as a whole when viewed along an axial direction of the fan wheel. The larger the overlapping area, the higher the resistance. In other words, the smaller the overlapping area, the lower the resistance. By using the adjustment handle 34 and the pulling wire 35, the movable seat 32 can slide up and down on the fixed seat 31 so as to adjust the amount of the overlapping area between the neodymium magnets 33 and assembly of the iron ring 21 and the aluminum ring 22 as a whole when viewed along the axial direction of the fan wheel.

According to the above technical solutions, the present invention provides the iron ring 21 and the aluminum ring 22 on one side of the fan wheel 2, and also provides a movable seat 32 which is movable with respect to the fan wheel 2, and neodymium magnets 33 are mounted on the movable seat 32. Accordingly, the fan bike is additionally equipped with adjustable non-contact type magnetically controlled resistance. Specifically, magnetically controlled resistance is achieved by non-contact action force between the neodymium magnets 33 and the aluminum ring 22 that achieves cutting of magnetic field lines to create reaction force that constitutes a resistant force against the rotation of the fan wheel 2. Such magnetically controlled resistance force is stable and adjustable. User may freely choose among different levels of stable resistance provided by the present invention a suitable resistance for training by operating the adjustment handle 34. During training, the legs and hands can apply balanced forces and hence the user is saved from easy muscle injuries. Also, during training, stable wind resistance is provided by the fan bike and wind may be generated during training, therefore providing a better training experience and more prominent training effect.

The forms and types of the present invention should not be limited by the embodiment described above and the accompanying drawings. Any non-inventive changes or modifications of the present invention by any person skilled in the art should fall within the scope of the present invention.

What is claimed is:

1. A fan bike providing magnetically controlled resistance, comprising a fan wheel and a micro adjustment assembly, both installed on a bike frame;

the fan wheel is rotatably mounted on the bike frame; one side of the fan wheel is fixedly connected sequentially with an iron ring and an aluminum ring; the iron ring and the aluminum ring are co-axial with the fan wheel;

the micro adjustment assembly comprises a fixed seat, a movable seat, at least one neodymium magnet, an adjustment handle, and a pulling wire; the fixed seat is mounted inside the bike frame; the movable seat and the fixed seat are slidably connected; the neodymium magnet is mounted on the movable seat, and faces towards a side of the aluminum ring facing opposite to the iron ring; the adjustment handle is movably mounted outside the bike frame; two ends of the pulling wire are connected to the movable seat and the adjustment handle respectively.

2. The fan bike of claim 1, wherein a plurality of blades are provided circumferentially around the fan wheel; the blades are spaced apart from one another by a same angle.

3. The fan bike of claim 1, wherein the fan wheel is positioned on one side of the iron ring facing opposite to the aluminum ring; the aluminum ring is positioned on another side of the iron ring facing opposite to the fan wheel; said another side of the iron ring facing opposite to the fan wheel is also provided with an installation groove in which the aluminum ring is mounted.

4. The fan bike of claim 1, wherein the fan wheel is rotatably connected to the bike frame through a rotational shaft; a bearing is also provided between the rotational shaft and the fan wheel.

5. The fan bike of claim 1, wherein a side of the fixed seat facing towards the fan wheel is provided with a sliding rail; a side of the movable seat facing away from the fan wheel is provided with a sliding block; the sliding block is slidably mounted on the sliding rail.

6. The fan bike of claim 5, wherein the sliding rail is oriented along a radial direction of the fan wheel.

7. The fan bike of claim 1, wherein an upper end of the fixed seat is provided with a notch that mounts the pulling wire.

8. The fan bike of claim 1, wherein a side of the movable seat facing towards the fan wheel is provided with an arc-shaped mounting plate; a plurality of neodymium magnets are fixedly connected to the mounting plate.

9. The fan bike of claim 1, wherein an outer side of the bike frame is provided with a pivotal seat; one end of the adjustment handle is pivotally mounted to the pivotal seat.

10. The fan bike of claim 1, wherein the micro adjustment assembly further comprises a spring connected between the bike frame and the movable seat; an upper end of the movable seat is fixedly connected with a lower end of the pulling wire; a lower end of the movable seat is fixedly connected with an upper end of the spring; a lower end of the spring is fixedly connected in an interior of the bike frame.

* * * * *